US008756968B2

(12) United States Patent
Etienne

(10) Patent No.: US 8,756,968 B2
(45) Date of Patent: Jun. 24, 2014

(54) SHAPING STATION OF A WIRE SHAPING MACHINE WITH ANNULAR TOOL HOLDER ARM

(75) Inventor: Joël Etienne, Saint Die des Vosges (FR)

(73) Assignee: Numalliance SAS, Saint Michel sur Meurthe (FR)

( * ) Notice: Subject to any disclaimer, the term of this patent is extended or adjusted under 35 U.S.C. 154(b) by 320 days.

(21) Appl. No.: 12/934,003

(22) PCT Filed: Mar. 26, 2009

(86) PCT No.: PCT/FR2009/000336

§ 371 (c)(1),
(2), (4) Date: Sep. 22, 2010

(87) PCT Pub. No.: WO2009/133259

PCT Pub. Date: Nov. 5, 2009

(65) Prior Publication Data

US 2011/0016942 A1 Jan. 27, 2011

(30) Foreign Application Priority Data

Mar. 27, 2008 (FR) ..... 08 51973

(51) Int. Cl.
*B21D 11/06* (2006.01)
*B21F 3/00* (2006.01)

(52) U.S. Cl.
USPC ..... 72/307; 72/145

(58) Field of Classification Search
USPC ..... 72/135, 145, 168, 306, 307, 138, 141, 72/142, 298, 299
See application file for complete search history.

(56) References Cited

U.S. PATENT DOCUMENTS

| | | | | |
|---|---|---|---|---|
| 4,391,116 | A | 7/1983 | Yogo | |
| 5,239,850 | A * | 8/1993 | Shimokata | 72/17.3 |
| 6,142,002 | A * | 11/2000 | Itaya | 72/137 |
| 6,857,303 | B2 * | 2/2005 | Latour | 72/307 |
| 2008/0302155 | A1 * | 12/2008 | Tsuritani | 72/135 |

FOREIGN PATENT DOCUMENTS

| | | | |
|---|---|---|---|
| JP | 2007030038 | A | 2/2007 |
| WO | 0174512 | A | 10/2001 |

* cited by examiner

*Primary Examiner* — Debra Sullivan
(74) *Attorney, Agent, or Firm* — Egbert Law Offices, PLLC

(57) ABSTRACT

The invention relates to a shaping station of a metal wire shaping sequence machine, a machine wherein a wire feed station supplies the wire along a travel axis through a bending nose which brings the wire in front of tools of a bending head which can be moved about the wire travel axis. The bending head is supported by an annular arm centered on the travel axis, and mounted to rotate about said travel axis. Preferably, the annular arm, with the guiding in rotation thereof by rollers and a toothed ring, are mounted on a support plate positioned vertically and perpendicularly to the wire travel axis. In addition, the support plate can be moved in horizontal and vertical translation in a plane perpendicular to the wire travel axis, which also is the arm rotation axis.

5 Claims, 2 Drawing Sheets

SHAPING STATION OF A WIRE SHAPING MACHINE WITH ANNULAR TOOL HOLDER ARM

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a shaping station in a metal wire shaping machine.

2. Description of Related Art Including Information Disclosed Under 37 CFR 1.97 and 37 CFR 1.98.

The word metal wire is a generic term professionally used, which means a wire proper as well as a bar or a tube.

A numerically controlled shaping sequence machine carries out various shaping operations on a wire, such as for example cambering, bending, etc . . . and includes various stations successively gone through by the wire.

The wire travels from a feed station which feeds the wire to a shaping station where it is bent and shaped by tools.

Such a machine can make three-dimension parts by sequential or successive bendings along different planes.

The prior art knows two configurations of shaping stations, i.e. those which execute the changes in planes between two successive bendings by the relative rotation of the wire with respect to stationary bending tools, and those which execute the changes in planes by placing the bending tools and the actuators thereof on an arm rotating about the wire stationary axis.

In the first configuration, when and as the part is shaped and thus gains in volume and weight, the wire orientation speed must be slowed down to limit the effects of inertia on the part and not degrade the capability on the angles between two bending planes.

In the second configuration, the problem arises of integrating the actuator and the energy on the rotation arm, which imposes high inertia from the rotating part and requires the implementation of expensive and sensitive components for the connexion to energy: rotating electric collectors, pneumatic or hydraulic rotating seals, etc . . .

The applicant's aim is to solve such problems resulting from the second configuration.

BRIEF SUMMARY OF THE INVENTION

For this purpose, she thought of replacing the rectilinear arm of the prior art by an annular arm supporting the bending tools and being able, through rotation and/or translation movements, to position or orient said tools with respect to the wire and with respect to the bending nose, according to the bending to be executed.

Said bending nose is the second part of the tools. It guides the wire and has a variable reaction to the first tools, because of the combination of a rotation about the wire travel axis, and a translation along the same axis.

More particularly, the invention includes a shaping station of a metal wire shaping sequence machine, a machine wherein a wire feed station supplies the wire along a travel axis through a bending nose, the shape of which participates in the shaping of the wire as a reaction to the tools of a bending head which can be moved about the wire travel axis, characterized in that the bending head is supported by an annular arm centered on the travel axis and mounted to rotate, and the rotation axis of which is parallel to the travel axis.

According to a preferred embodiment, the annular arm, with the guiding in rotation thereof by rollers and a toothed ring, is mounted on a support plate positioned vertically and perpendicularly to the wire travel axis.

The support plate can be moved horizontally and vertically in translation in a plane perpendicular to the travel axis.

BRIEF DESCRIPTION OF THE DRAWINGS

The invention and the advantages thereof will be better understood when reading the following description and referring to the appended drawings, wherein.

DETAILED DESCRIPTION OF THE INVENTION

Figure 1:
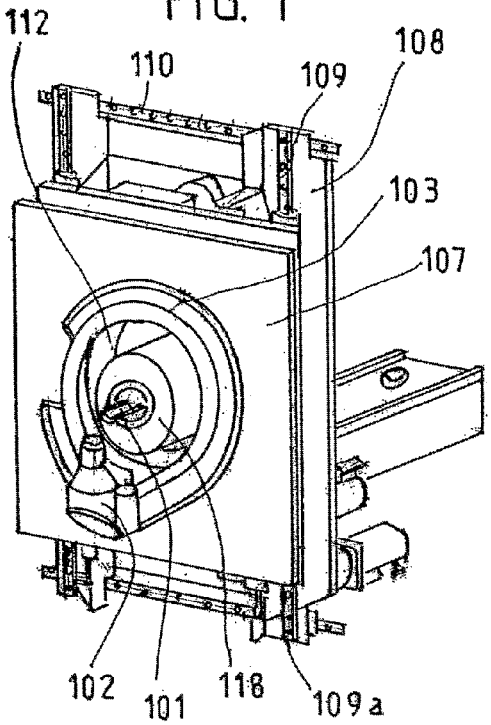
FIGS. 1 and 2 are front and rear perspective views of the invention.

As anon-limiting example, when leaving a feed station 1 which is the subject of an application for a patent filed on the same day, a wire 2 goes along a travel axis 3 through a bending nose 101 and is brought in front of bending tools (not shown) and supported by a bending head 102 which is supported by an annular arm 103, with such assembly being supported by a machine frame.

The annular arm 103 is mounted to rotate with respect to a support plate 107 and about the travel axis 3.

The annular arm 103, with the guiding in rotation thereof by rollers 104 and a toothed ring 105, and the actuators thereof (i.e. engines 106) are mounted, according to a preferred embodiment, on a support plate 107 positioned vertically and perpendicularly to the wire travel axis 3.

The support plate 107 can be moved horizontally and vertically in translation in a plane perpendicular to the travel axis 3, which is also the axis of rotation of the arm 103 remaining parallel to the wire travel axis 3 upon the motion of the support plate 107. Of course, the case where the arm 103 rotation axis coincides with the wire travel axis 3 must be considered as a particular case of parallelism of both axes.

For this purpose, the plate is mounted on the one hand on a carriage 108 which can be vertically moved by first translation means 109, for example a vertical rack-and-pinion system 109*a* and a driving motor 109*b*, and on the other hand on a carriage 108 which can be horizontally moved by second translation means 111, for example a horizontal rack-and-pinion system 111*a* and a driving motor 111*b*.

The support plate 107 further includes a circular opening 112 coaxial with the toothed ring 105, with a smaller diameter. Such circular opening is used for enabling a cylindrical support 118 having a horizontal axis which is identical to the travel axis 3 and supporting a bending nose 101 to go therethrough.

The annular arm 103 further supports a bending head 102, the tools of which are not shown in the Figures, which can be oriented with respect to the arm and about a vertical axis 113.

The orientation of the head about the axis 113 results in the bending of the wire on the bending tools and on the nose along a requested angle, and it is induced by a beveled gearing 123 driven into rotation by an engine 123*a* combined with a rack-and-pinion pulley 123*b* or any equivalent means.

Such a configuration of the annular arm supporting a bending head, the driving into rotation of which is concentric and integrated in the guiding of the arm, makes it possible not to have any actuator mounted on the arm which must be as dynamic as possible. Thanks to this construction, the inertia of the mobile assembly is reduced, which avoids all the problems linked to the costs and the reliability of the rotating collectors.

Such construction enables an unlimited rotation of the arm with having a rotating collector, like the prior art.

The possibility of crossed movements of the plate 107 combined with the rotation of the head 112 makes it possible to position and to orient the bending tools with respect to the wire. According to the required configurations and bending direction, the tools mounted on the bending head 112 can thus be placed on the left, on the right of, or centered with respect to the wire 2 axis 3.

Considering the small movement amplitude required for positioning the tools with respect to the wire, the impact of inertia linked with the integrated masses is limited.

Such construction makes it possible to move the carriages in an annular clearance 114 the width of which is determined by a horizontal 115 clearance and a vertical 116 clearance centered on the wire outlet 117, at the bending nose 101.

The nose 101 is a semi-cylindrical nose which is, in this construction, axially supported by a cylindrical support 118 mentioned above.

Figure 2:
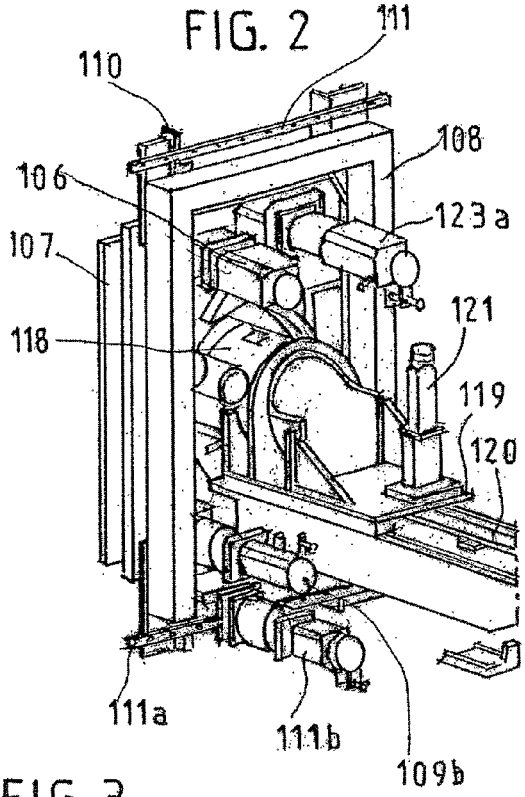
Figure 3:
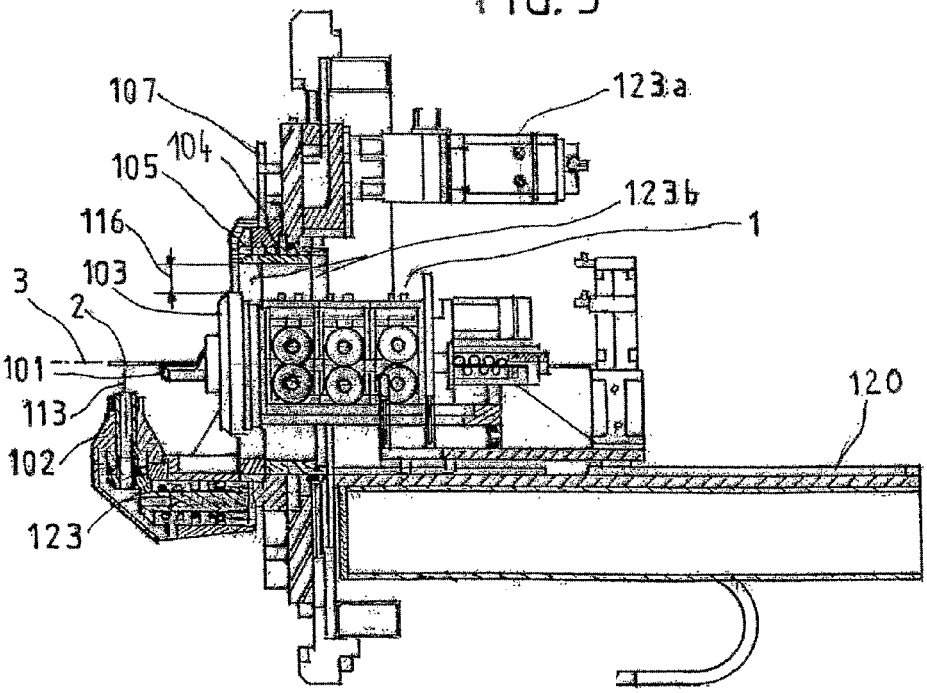
FIG. 3 is a vertical sectional of a machine including a shaping station according to the invention.
Figure 4:
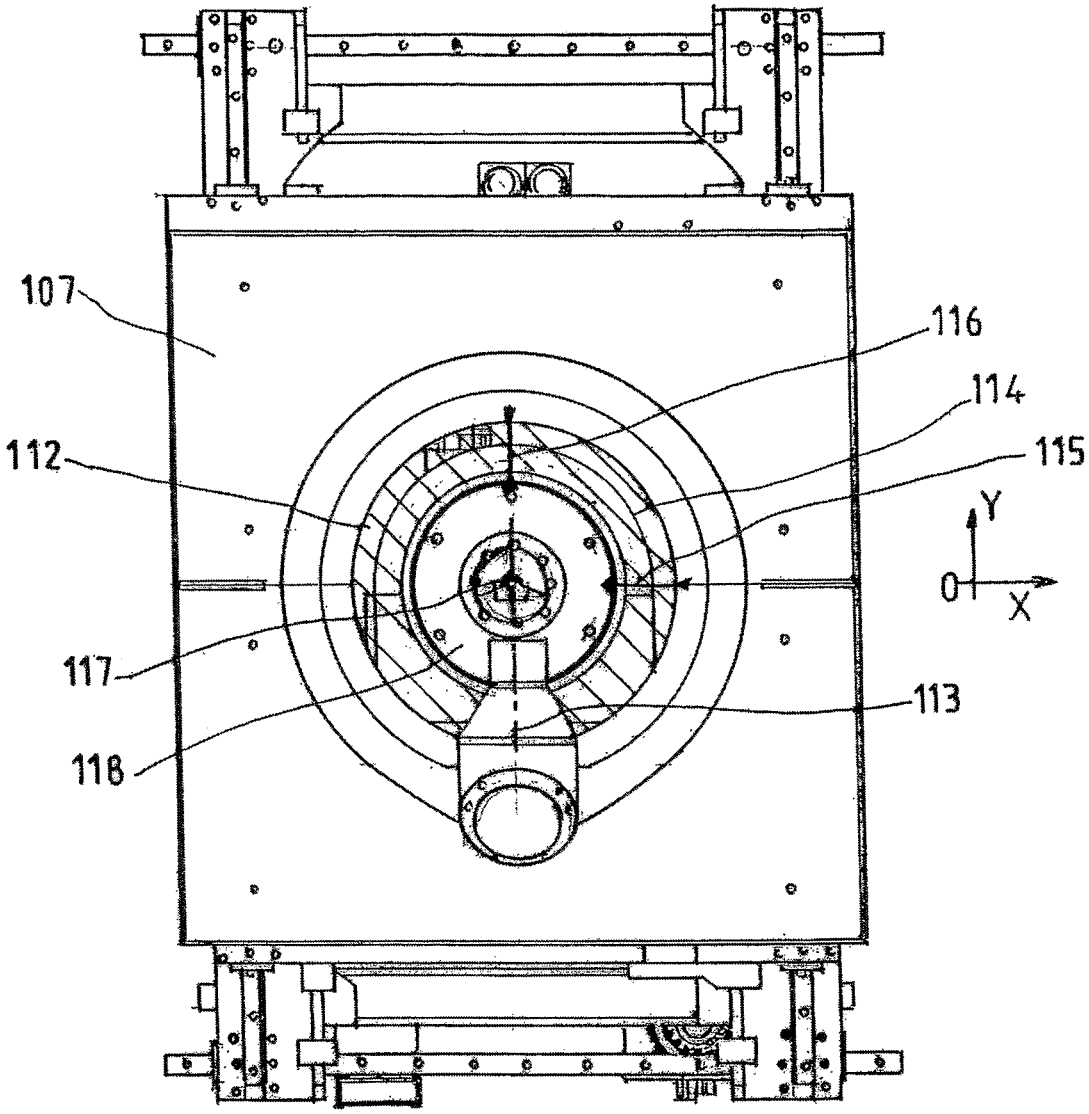
FIG. 4 is a front view of the shaping station according to the invention.

Such cylindrical support 118 is mounted on a carriage 119 which can be moved in horizontal translation parallel to the travel axis 3 by any appropriate means, for example a rack-and-pinion system 120 and driven by a motor 121. Said carriage also supports the feed station 1 not shown in FIG. 2 but visible in FIG. 3, which feeds and drives the wire along the travel axis 3.

The value of the vertical 116 or horizontal 115 clearance is determined by the distance between the radius of the opening 112 and the external radius of the cylindrical support 118 and limits the carriage 114 clearance.

The translation movement of the cylindrical support 118 and the nose 101 transforms a circular working area centered on the wire axis, the diameter of which corresponds to the clearance of the carriages, into a tubular working space and makes it possible to bend the wire, either by combining the actions of the bending tools with the action of the nose, either by removing the nose so as to use the bending tools only. The wire can also be cut at the wire outlet 117 using one of the two translation movements of the support plate 107, which causes a shearing of the wire at the wire outlet 117.

The combination of the translation movements along three axes (Ox, Oy, Oz) with the rotation movements of the arm and the bending head makes it possible to obtain three-dimension bendings, along all possible directions.

The controls of the various engines are managed by a numerical control, the programming of which can be made by the persons skilled in the art.

The invention has been described according to a preferred and non limiting embodiment which encompasses the technical equivalents, more particularly as regards the mechanical driving means for the various movements.

The advantages of the invention are numerous and are mainly as follows:

- large variety of possible shapes thanks to the multiple active parts in the tools, which can be selected in the working space, and thanks to the combination of movements of the bending nose and the bending tool. Such variety is obtained through the implementation of only one head, so that the current state of the art uses one per operation,
- possibility of cutting the wire with the same tool as the cambering one,
- quicker shaping through the reduction of inertia by not integrating the actuators,
- quicker shaping through the combination of the bending nose and the bending head,
- possibility of simultaneously executing two reverse coplanar bendings (having identical angles or not).

I claim:

1. A wire shaping apparatus comprising:

a wire feed station having a bending nose, said wire feed station having wire extending therethrough along a travel axis, said wire passing outwardly through said bending nose;

a bending head cooperative with said wire feed station so as to shape the wire passing through said bending nose, said bending head being movable about the travel axis;

a support plate positioned adjacent to said bending nose of said wire feed station, said support plate being movable in vertical translation and in horizontal translation in a plane perpendicular to the travel axis;

an annular arm supporting said bending head so as to rotate with respect to said support plate about a rotation axis parallel to the travel axis, said annular arm being guided in rotation by rollers and a toothed ring and an actuator mounted on said support plate.

2. The wire shaping apparatus of claim 1, said support plate having a circular opening coaxial to said annular arm, said bending nose extendable through said circular opening.

3. The wire shaping apparatus of claim 1, said bending head extending along a vertical axis.

4. The wire shaping apparatus of claim 1, said bending nose being axially support by a cylindrical support which is mounted to a carriage, said carriage movable in horizontal translation parallel to the travel axis.

5. The wire shaping apparatus of claim 1, said bending head being driven in rotation about a vertical axis by beveled gearing cooperative with said annular arm.

* * * * *